US009453179B2

(12) United States Patent
Sato

(10) Patent No.: US 9,453,179 B2
(45) Date of Patent: Sep. 27, 2016

(54) LUBRICATING OIL COMPOSITION FOR AIR COMPRESSORS

(71) Applicant: IDEMITSU KOSAN CO., LTD., Chiyoda-ku (JP)

(72) Inventor: Tokue Sato, Ichihara (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 14/388,563

(22) PCT Filed: Mar. 26, 2013

(86) PCT No.: PCT/JP2013/058839

§ 371 (c)(1),
(2) Date: Sep. 26, 2014

(87) PCT Pub. No.: WO2013/146805

PCT Pub. Date: Oct. 3, 2013

(65) Prior Publication Data

US 2015/0051126 A1 Feb. 19, 2015

(30) Foreign Application Priority Data

Mar. 29, 2012 (JP) ..... 2012-077569

(51) Int. Cl.

| | |
|---|---|
| ***C07D 251/54*** | (2006.01) |
| ***C10M 137/10*** | (2006.01) |
| ***C10M 173/02*** | (2006.01) |
| ***C10M 133/08*** | (2006.01) |
| ***C10M 169/04*** | (2006.01) |
| ***C10M 133/12*** | (2006.01) |

(52) U.S. Cl.

CPC ..... *C10M 169/04* (2013.01); *C10M 133/12* (2013.01); *C10M 2205/003* (2013.01); *C10M 2205/0285* (2013.01); *C10M 2207/2805* (2013.01); *C10M 2207/2835* (2013.01); *C10M 2209/1033* (2013.01); *C10M 2209/1055* (2013.01); *C10M 2209/1065* (2013.01); *C10M 2209/1075* (2013.01); *C10M 2215/06* (2013.01); *C10M 2215/064* (2013.01); *C10M 2215/065* (2013.01); *C10N 2220/022* (2013.01); *C10N 2230/10* (2013.01); *C10N 2240/30* (2013.01)

(58) Field of Classification Search

CPC ..... C10M 2215/222; C10M 2207/129; C10M 2215/042; C10N 2210/02

USPC ..... 508/258, 429, 511, 562, 563

See application file for complete search history.

(56) References Cited

U.S. PATENT DOCUMENTS

| | | | | |
|---|---|---|---|---|
| 4,111,821 | A * | 9/1978 | Lazarus et al. | 508/298 |
| 5,895,778 | A | 4/1999 | McHenry et al. | |
| 5,994,277 | A * | 11/1999 | Ritchie et al. | 508/365 |
| 6,255,262 | B1 * | 7/2001 | Keenan et al. | 508/486 |
| 2007/0032391 | A1 * | 2/2007 | Tagawa et al. | 508/421 |
| 2007/0129268 | A1 | 6/2007 | Bell et al. | |
| 2009/0186785 | A1 | 7/2009 | Kamimura | |
| 2009/0312209 | A1 | 12/2009 | Ikai | |
| 2010/0144567 | A1 * | 6/2010 | Ito | C10M 169/04 508/192 |
| 2010/0234256 | A1 | 9/2010 | Sato et al. | |

FOREIGN PATENT DOCUMENTS

| | | | |
|---|---|---|---|
| CN | 1836030 | A | 9/2006 |
| CN | 101072855 | A | 11/2007 |
| EP | 2 157 160 | A1 | 2/2010 |
| JP | 52-14175 | | 2/1977 |
| JP | 1-204995 | | 8/1989 |
| JP | 9-132788 | | 5/1997 |
| JP | 2000-87060 | | 3/2000 |
| JP | 2002-538230 | | 11/2002 |
| JP | 2005-187645 | | 7/2005 |
| JP | 2007-161773 | | 6/2007 |
| JP | 2007-270090 | | 10/2007 |
| JP | 2008-45111 | | 2/2008 |
| JP | 2009-511728 | | 3/2009 |
| JP | 2011-162629 | | 8/2011 |
| WO | WO 2008/134179 | A2 | 11/2008 |
| WO | 2009/066722 | | 5/2009 |
| WO | WO 2013/017332 | A1 | 2/2013 |

OTHER PUBLICATIONS

Extended European Search Report issued Sep. 28, 2015 in Patent Application No. 13767987.4.

"Irganox L 06", Antioxidant for synthetic lubricants, BASF Aerospace Materials, XP 055214034, Dec. 2011, 2 Pages.

International Search Report issued Jul. 2, 2013 in PCT/JP13/058839 Filed Mar. 26, 2013.

Combined Office Action and Search Report issued Sep. 30, 2015 in Chinese Patent Application No. 201380017848.9 (with English Translation of Category of Cited Documents).

* cited by examiner

*Primary Examiner* — Vishal Vasisth

(74) *Attorney, Agent, or Firm* — Oblon, McClelland, Maier & Neustadt, L.L.P.

(57) ABSTRACT

A lubricating oil composition for an air compressor according to the present invention contains a synthetic base oil, and one or more amine-based antioxidants selected from the group consisting of asymmetric diphenylamine-based compounds, phenylnaphthylamine-based compounds, asymmetric dinaphthylamine-based compounds, dialkyl monophenylamine-based compounds and dialkyl mononaphthylamine-based compounds.

10 Claims, No Drawings

LUBRICATING OIL COMPOSITION FOR AIR COMPRESSORS

CROSS REFERENCE TO RELATED APPLICATIONS

This application is a 371 of PCT/JP13/58839, filed Mar. 26, 2013, the disclosure of which is incorporated herein by reference in its entirety. Priority to Japanese patent application 2012-077569, filed Mar. 29, 2012, the disclosure of which is incorporated herein by reference in its entirety.

TECHNICAL FIELD

The present invention relates to a lubricating oil composition for an air compressor, and, more particularly, to a lubricating oil composition for use in, for example, screw type air compressors.

BACKGROUND ART

Conventionally, various improvements have been made to lubricating base oils and antioxidants for use in lubricating oils for air compressors. For example, Patent Document 1 discloses a lubricating oil composition for an air compressor obtained by blending a lubricating base oil having a viscosity index of 120 or higher with an amine-based antioxidant, such as alkylphenyl α-naphthylamine or p,p'-dialkyldiphenylamine.

Because lubricating oils for air compressors are used under severe conditions for a long period of time, it is required to prevent oxidation of the lubricating oils under high temperature for a long period of time. However, the amount of the antioxidant blended into the lubricating oil composition of Patent Document 1 is too small to suppress oxidation to a satisfactory extent under high temperature. One possible method for preventing oxidation is to increase the amount of antioxidant. However, because a mineral oil-based base oil having a low solubility to the antioxidant is used as the lubricating base oil of the lubricating oil composition in Patent Document 1, the increase of the amount of antioxidant causes the generation of sludge, resulting in failures such as compressor trouble.

On the other hand, polyglycol-based or ester-based synthetic base oils have the advantages of being less likely to generate sludge, due to high solubility of various additive thereto. Thus, various additives could be blended at high ratios into a lubricating oil using a synthetic base oil. However, if an antioxidant conventionally used in synthetic base oils is blended into a synthetic base oil at a high ratio without modification, a problem, such as an increase in viscosity to a level that makes it unusable as a lubricating oil or an unintended increase in acid value, may occur. The current situation is that proper selection of antioxidant suitable for synthetic base oils has yet to be made.

As described above, a lubricating oil for an air compressor has not been conventionally developed which can successfully stabilize the acid value under high temperature over a long period of time and can prevent the generation of sludge.

PRIOR ART DOCUMENTS

Patent Documents

[Patent Document 1] JP 2011-162629A

SUMMARY OF THE INVENTION

Problems to be Solved by the Invention

The present invention has been made in view of the above circumstances, and it is therefore an object of the present invention to provide a lubricating oil composition for an air compressor that can appropriately suppress oxidation of the lubricating oil and can also prevent the generation of sludge.

Means for Solving the Problems

The present inventor conducted intensive studies to solve the above problems, and consequently, found that the problem can be solved by using a specific amine-based antioxidant when a synthetic base oil is used as a base oil.

In other words, the present invention provides the following (1) to (8).

(1) A lubricating oil composition for an air compressor, containing a synthetic base oil, and one or more amine-based antioxidants selected from the group consisting of asymmetric diphenylamine-based compounds, phenylnaphthylamine-based compounds, asymmetric dinaphthylamine-based compounds, dialkyl monophenylamine-based compounds and dialkyl mononaphthylamine-based compounds.

(2) The lubricating oil composition for an air compressor according to above (1), in which the synthetic base oil is one or more synthetic base oils selected from the group consisting of polyglycol-based synthetic oils, ester-based synthetic oils and poly-α-olefin-based synthetic oils.

(3) The lubricating oil composition for an air compressor according to above (2), in which the synthetic base oil is a mixed oil of a polyglycol-based synthetic oil and an ester-based synthetic oil.

(4) The lubricating oil composition for an air compressor according to above (2) or (3), in which 70 mol % or more of the main chain moiety of the polyglycol-based synthetic oil is C3 to C4 oxyalkylene units.

(5) The lubricating oil composition for an air compressor according to above (4), in which the polyglycol-based synthetic oil contains a C1 to C4 alkyl group at a terminal end thereof.

(6) The lubricating oil composition for an air compressor according to any one of above (2) to (5), in which the ester-based synthetic oil is an ester of a pentaerythritol with a saturated fatty acid.

(7) The lubricating oil composition for an air compressor according to any one of above (1) to (6), containing 3% by mass to 10% by mass of the amine-based antioxidant.

(8) The lubricating oil composition for an air compressor according to any one of above (1) to (7), in which the synthetic base oil has a kinematic viscosity at 100° C. of 6 to 12 $mm^2/s$.

Effect of the Invention

In the present invention, a lubricating oil that can prevent the generation of sludge and suppress oxidation of the lubricating oil and is therefore suitable for use in air compressors can be provided by using a synthetic base oil as a base oil and using an asymmetric amine-based antioxidant.

Modes for Carrying Out the Invention

A preferred embodiment of the present invention is hereinafter described in detail.

A lubricating oil composition for an air compressor according to this embodiment contains a synthetic base oil and an asymmetric amine-based antioxidant.

The synthetic base oil that is used in the present invention is a polyglycol-based synthetic oil, ester-based synthetic oil or poly-α-olefin-based synthetic oil, or a mixed base oil of two or more kinds selected therefrom.

In the present invention, oxidation of the lubricating oil can be stably suppressed over a long period of time by using the base oil and an asymmetric amine-based antioxidant. In addition, when the asymmetric amine-based antioxidant is added in a large amount, the acid value can be reduced according to the amount added and oxidation can be suppressed more appropriately. Further, even when the asymmetric amine-based antioxidant is added in a large amount, the antioxidant and its decomposition products dissolve in the base oil and sludge can be therefore successfully suppressed.

Among the above-mentioned base oils, the use of a polyglycol-based synthetic oil or ester-based synthetic oil is preferred in the present invention. In the present invention, the benefit of adding the asymmetric amine-based antioxidant can be notably obtained when these base oils are used.

Also, in the present invention, the use of a mixed base oil obtained by mixing a polyglycol-based synthetic oil and an ester-based synthetic oil as a base oil is further preferred from the standpoint of further suppression of sludge deposition and further improvement of oxidation stability (suppression of an increase in acid value).

[Polyglycol-Based Synthetic Oil]

The polyglycol-based synthetic oil is composed of polyoxyalkylene glycols. Examples of the polyoxyalkylene glycols include the compounds represented by general formula (I):

$$R^1—[(OR^2)_a—OR^3]_b \quad (I)$$

wherein $R^1$ represents a hydrogen atom, C1 to C10 monovalent hydrocarbon group, C2 to C10 acyl group, C1 to C10 hydrocarbon group having 2 to 6 binding sites or C1 to C10 oxygen-containing hydrocarbon group, $R^2$ represents a C2 to C4 alkylene group, $R^3$ represents a hydrogen atom, C1 to C10 hydrocarbon group, C2 to C10 acyl group or C1 to C10 oxygen-containing hydrocarbon group, "b" represents an integer of 1 to 6, and "a" represents such a number that the average of "a×b" is 6 to 80.

In general formula (I), $R^1$ is preferably a C1 to C10 monovalent hydrocarbon group.

Also, the C1 to C10 monovalent hydrocarbon group in each of $R^1$ and $R^3$ in general formula (I) above may be linear or branched, or these may be cyclic. The hydrocarbon group is preferably an alkyl group, and specific examples thereof include a methyl group, an ethyl group, an n-propyl group, an isopropyl group, various butyl groups, various pentyl groups, various hexyl groups, various heptyl groups, various octyl groups, various nonyl groups, various decyl groups, a cyclopentyl group, and a cyclohexyl group. The number of carbon atoms of the alkyl group is preferably 1 to 4. When the number of carbon atoms of the alkyl group is small as described above, the asymmetric amine-based antioxidant exhibits good solubility and sludge is therefore less likely to be generated.

The hydrocarbon group moiety in the C2 to C10 acyl group in each of $R^1$ and $R^3$ may be linear or branched, or these may be cyclic. The hydrocarbon group moiety of the acyl group preferably is an alkyl group, and as specific examples thereof include various C1 to C9 groups that are same as the above-mentioned specific examples of the alkyl groups. When the number of carbon atoms of the acyl group is 10 or less, the amine-based antioxidant exhibits good solubility and sludge is therefore less likely to be generated. The number of carbon atoms of the acyl group is preferably 2 to 4.

When both $R^1$ and $R^3$ are a hydrocarbon group or an acyl group, $R^1$ and $R^3$ may be the same as or different from each other.

Further, when "b" is 2 or greater, the plurality of $R^3$s in one molecule may be the same as or different from each other.

When $R^1$ is a C1 to C10 hydrocarbon group having 2 to 6 binding sites, the hydrocarbon group may be linear or branched, or these may be cyclic. As the hydrocarbon group having two binding sites, aliphatic hydrocarbon groups are preferred and examples thereof include ethylene group, propylene group, butylene group, pentylene group, hexylene group, heptylene group, octylene group, nonylene group, decylene group, cyclopentylene group and cyclohexylene group. Examples of other hydrocarbon groups include residues obtained by removing a hydroxyl group from biphenol, or bisphenols such as bisphenol F and bisphenol A. Also, as the hydrocarbon group having 3 to 6 binding sites, aliphatic hydrocarbon groups are preferred, and examples thereof include residues obtained by removing a hydroxyl group from polyhydric alcohols, such as trimethylolpropane, glycerin, pentaerythritol, sorbitol, 1,2,3-trihydroxycyclohexane, and 1,3,5-trihydroxycyclohexane.

When the number of carbon atoms of the aliphatic hydrocarbon group is 10 or less, the amine-based antioxidant exhibits good solubility and sludge is therefore less likely to be generated.

In addition, examples of the $C_1$ to $C_{10}$ oxygen-containing hydrocarbon group in each of $R^1$ and $R^3$ include linear or branched aliphatic and cyclic aliphatic groups having an ether bond.

$R^2$ in general formula (I) is a C2 to C4 alkylene group and examples of the oxyalkylene group as the repeating unit include an oxyethylene group, an oxypropylene group, and an oxybutylene group. The oxyalkylene groups in one molecule may be the same, and two or more kinds of oxyalkylene groups may be contained in one molecule. However, a C3 to C4 oxyalkylene group, in other words, at least an oxypropylene group or oxybutylene group, is preferably contained in one molecule. In particular, it is more preferred that the oxyalkylene units contain 50 mol % or more of C3 to C4 oxyalkylene units, and it is especially preferred that the oxyalkylene units contain 70 mol % or more of C3 to C4 oxyalkylene units. It is most preferred that all the oxyalkylene units be the C3 to C4 oxyalkylene units. The oxyalkylene group in the repeating unit constitutes the main chain moiety of the polyoxyalkylene glycols, and containing a C3 to C4 oxyalkylene unit having a branched structure at the above rate in the main chain moiety as described above is preferred in that the stability of the base oil itself increases and the benefit of the asymmetric amine-based antioxidant is obtained more significantly.

In general formula (I), "b" represents an integer of 1 to 6, and is determined based on the number of binding sites in $R^1$. For example, "b" is 1 when $R^1$ is a hydrogen atom or alkyl group, and "b" are 2, 3, 4, 5 and 6 respectively, when $R^1$ is an aliphatic hydrocarbon group having two, three, four, five and six binding sites. Furthermore, "a" represents such a number that the average of a×b is 6 to 80, and when the average is 80 or less the asymmetric amine-based antioxidant exhibits good solubility. When the average is 6 or greater, it is possible to impart sufficient lubricating performance to the lubricating oil.

In the present invention, $R^1$ is preferably a hydrogen atom or alkyl group and "b" is preferably 1 in general formula (I). Further, at least one of $R^1$ and $R^3$ is preferably an alkyl group, particularly a C1 to C4 alkyl group, which means that a C1 to C4 alkyl group is preferably contained at a terminal end.

Incidentally, when "b" is 2 or greater, the plurality of $R^3$s in one molecule may be the same as or different from each other.

The polyoxyalkylene glycols represented by general formula (I) include polyoxyalkylene glycol having a hydroxyl group at a terminal thereof, and, when the content of the hydroxyl groups is at a ratio of 50% by mole or less with respect to an entirety of terminal groups, even when contained, the polyoxyalkylene glycol can be suitably used.

More specifically, the polyoxyalkylene glycols are preferably a compound represented by general formula (I').

$$R^4—(OR^5)_x—OR^6 \quad (I')$$

In general formula (I'), $R^4$ and $R^6$ each independently represents a C1 to C4 alkyl group or hydrogen atom, and at least one of $R^4$ and $R^6$ is a C1 to C4 alkyl group. The average of X is 6 to 80. $R^5$ represents a C2 to C4 alkylene group, and 50 mol % or more, preferably 70 mol % or more, of the alkylene groups are C3 to C4 alkylene groups.

Specific examples of the above preferred compound include polyoxypropylene glycol dimethyl ether; polyoxyalkylene glycol monomethyl ethers in which 50 mol % or more, preferably 70 mol % or more, of oxyalkylene units are oxybutylene groups; and polyoxybutylene glycol butylmethyl ether.

[Ester-Based Synthetic Oil]

The ester-based synthetic oil for use in the present invention is preferably a polyol ester. As the polyol ester, an ester of a diol or a polyol having about 3 to 20 hydroxyl groups with fatty acid having about 1 to 24 carbon atoms is preferably used.

Here, examples of the diols include ethylene glycol, 1,3-propanediol, propylene glycol, 1,4-butanediol, 1,2-butanediol, 2-methyl-1,3-propanediol, 1,5-pentanediol, neopentyl glycol, 1,6-hexanediol, 2-ethyl-2-methyl-1,3-propanediol, 1,7-heptanediol, 2-methyl-2-propyl-1,3-propanediol, 2,2-diethyl-1,3-propanediol, 1,8-octanediol, 1,9-nonanediol, 1,10-decanediol, 1,11-undecanediol, and 1,12-dodecanediol.

Examples of the polyol having about 3 to 20 hydroxyl groups include: polyhydric alcohols such as trimethylolethane, trimethylolpropane, trimethylolbutane,di-(trimethylolpropane), tri-(trimethylolpropane), pentaerythritol, di-(pentaerythritol), tri-(pentaerythritol), glycerin, polyglycerin (dimer to 20-mer of glycerin), 1,3,5-pentanetriol, sorbitol, sorbitan, a sorbitol glycerin condensate, adonitol, arabitol, xylitol, and mannitol; saccharides such as xylose, arabinose, ribose, rhamnose, glucose, fructose, galactose, mannose, sorbose, cellobiose, maltose, isomaltose, trehalose, sucrose, raffinose, gentianose, and merenditose; and partially etherified products of these and methyl glucoside (glucosides).

As the aliphatic acid for the ester, a C1 to C24 aliphatic acid is typically used, although the number of the carbon atoms thereof is not particularly limited. Among the C1 to C24 aliphatic acids, an aliphatic acid having 3 or more carbon atoms is preferred, an aliphatic acid having 4 or more carbon atoms is more preferred, an aliphatic acid having 5 or more carbon atoms is still more preferred, and an aliphatic acid having 10 or more carbon atoms is most preferred in terms of lubricity. In addition, to increase the solubility of the amine-based antioxidant in the lubricating base oil, a fatty acid having 18 or less carbon atoms is preferred, and a fatty acid having 12 or less carbon atoms is more preferred. The fatty acid may be either a linear fatty acid or a branched fatty acid. Further, the fatty acid may be either a saturated fatty acid or an unsaturated fatty acid, but the saturated fatty acid is preferred because oxidation of the lubricating oil can be suppressed.

Specific examples of the fatty acid include linear or branched type of pentanoic acid, hexanoic acid, heptanoic acid, octanoic acid, nonanoic acid, decanoic acid, undecanoic acid, dodecanoic acid, tridecanoic acid, tetradecanoic acid, pentadecanoic acid, hexadecanoic acid, heptadecanoic acid, octadecanoic acid, nonadecanoic acid, icosanoic acid, oleic acid, and so on; and a fatty acid having a quaternary α-carbon atom, namely so-called neo acid. More specifically, valeric (n-pentanoic) acid, caproic (n-hexanoic) acid, enanthic (n-heptanoic) acid, caprylic (n-octanoic) acid, pelargonic (n-nonanoic) acid, capric (n-decanoic) acid, oleic (cis-9-octadecenoic) acid, isopentanoic (3-methylbutanoic) acid, 2-methylhexanoic acid, 2-ethylpentanoic acid, 2-ethylhexanoic acid, and 3,5,5-trimethylhexanoic acid are preferred.

Incidentally, the polyol ester may be a partial ester in which some of the hydroxyl groups of a polyol remain without being esterified, may be a complete ester in which all of the hydroxyl groups of the polyol are esterified, or may be a mixture of the partial ester and the complete ester, but the polyol ester is preferably the complete ester.

Among these polyol esters, an ester of a hindered alcohol such as neopentyl glycol, trimethylolethane, trimethylolpropane, trimethylolbutane, di-(trimethylolpropane), tri-(trimethylolpropane), pentaerythritol, di-(pentaerythritol), and tri-(pentaerythritol) is preferred, an ester of pentaerythritol is more preferred, and an ester of pentaerythritol with a saturated fatty acid is most preferred, because such esters can prevent oxidation successfully and increase the solubility of the asymmetric amine-based antioxidant.

When a mixed base oil of the saturated fatty acid ester of pentaerythritol and the polyoxyalkylene glycols is used, the polyoxyalkylene glycols to be mixed is preferably the polyoxypropylene glycol dimethyl ether or the polyoxyalkylene glycol monomethyl ether in which 50 mol % or more, preferably 70 mol % or more, of the oxyalkylene units are oxybutylene groups.

[Poly-α-olefin-based Synthetic Oil]

As the poly-α-olefin for use in the present invention, various kinds of poly-α-olefins can be used. A polymer of a C8 to C18 α-olefin is typically used. Among such polymers, polymers of 1-dodecene, 1-decene or 1-octene can be mentioned as the preferred examples from the standpoint of thermal stability, lubricating properties and so on. Among these, trimers and tetramers of 1-decene are preferred. Incidentally, in the present invention, a hydrogenated product of a poly-α-olefin, in particular, is preferably used from the standpoint of thermal stability. These poly-α-olefins may be used singly or in combination.

[Asymmetric Amine-Based Antioxidant]

The asymmetric amine-based antioxidant for use in the present invention is a secondary or tertiary aromatic amine in which at least one substituent bonded to the nitrogen atom is different from the others. For example, secondary amines in which two substituents bonded to the nitrogen atom have the same structure, such as p,p'-dioctyldiphenylamine and p,p'-dinonyldiphenylamine, and tertiary amines in which the three substituents bonded to the nitrogen atom have the same structure are not included. Specific examples thereof include asymmetric diphenylamine-based compounds, phenylnaphthylamine-based compounds, asymmetric dinaphthylamine-based compounds, dialkyl monophenylamine-based compounds and dialkyl mononaphthylamine-based compounds.

The asymmetric diphenylamine-based compounds are secondary amines having two benzene rings bonded to the nitrogen atom of the amine, and specifically, are amines represented by general formula (II) below.

[Chemical Formula 1]

(II)

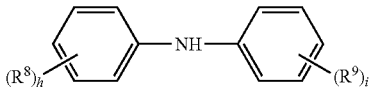

In general formula (II), $R^8$ and $R^9$ each independently represents a C1 to C20 alkyl group, and "h" and "i" each independently represents an integer of 0 to 4. Two or more of $R^8$ and $R^9$ may be the same as or different from each other. The asymmetric diphenylamine-based compounds of general formula (II) are asymmetric with making the structures of the functional groups bonded to the nitrogen atom different from each other.

In general formula (II), both "h" and "i" are preferably 1. In addition, $R^8$ and $R^9$ are preferably each independently a C1 to C10 alkyl group. The amine-based antioxidant represented by general formula (II) is preferably asymmetric with $R^8$ and $R^9$ being alkyl groups having different numbers of carbon atoms from each other. Also, when "h" and "i" are both 1, $R^8$ and $R^9$ are preferably located in the same position (p-position, o-position or m-position), and both are preferably located in the p-position from the standpoint of easiness of production and so on.

Further, from the standpoint of ensuring high asymmetricity, the number of carbon atoms of $R^8$ and the number of carbon atoms of $R^9$ are preferably both 3 or greater and different from each other. In this case again, it is more preferred that "h" and "i" be both 1. Preferred examples of the compound include monobutylphenyl-monooctylphenylamine. As the base oil used in combination with the compound of general formula (II), the polyoxyalkylene glycols are preferred and the polyoxybutylene glycol butylmethyl ether is especially preferred.

The phenylnaphthylamine-based compounds are compounds in which one benzene ring and one naphthalene ring are bonded to the nitrogen atom of the amine, and specifically, are compounds represented by general formula (III) below. The phenylnaphthylamine-based compounds are secondary amines, and have an asymmetric structure since one of the two bounded to the nitrogen atom is a benzene ring and the other is a naphthalene ring.

[Chemical Formula 2]

-continued (III)

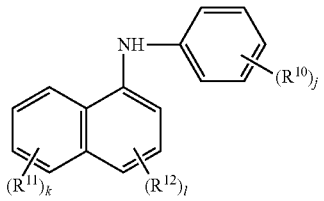

In general formula (III), $R^{10}$, $R^{11}$ and $R^{12}$ each independently represents a C1 to C20 alkyl group, preferably a C1 to C10 alkyl group, and "j", "k" and "l" each independently represents an integer of 0 to 4 with (k+l) being 0 to 4. Two or more of $R^{10}$, $R^{11}$ and $R^{12}$ may be the same as or different from each other.

In general formula (III), from the standpoint of easiness of production and so on, "j" is preferably 0 or 1 with (k+l) being 0, and $R^{10}$ is more preferably located in the p-position additionally. Preferred Examples of the compounds include phenyl-α-naphthylamine and p-tert-octylphenyl-1-naphthylamine. As the base oil used in combination with the compound of general formula (III), the poly-α-olefin or the saturated fatty acid ester of pentaerythritol is preferred.

The asymmetric dinaphthylamine-based compounds are secondary amines in which two naphthalene rings are bonded to the nitrogen atom of the amine, and specifically, are amines represented by general formula (IV) below.

[Chemical Formula 3]

(IV)

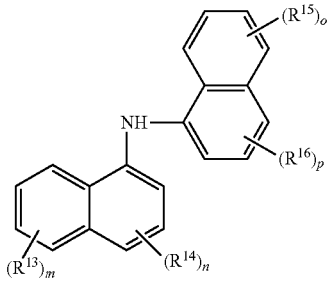

In general formula (IV), $R^{13}$, $R^{14}$, $R^{15}$ and $R^{16}$ each independently represents a C1 to C20 alkyl group, preferably a C1 to C10 alkyl group, and "m", "n", "o" and "p" each independently represents an integer of 0 to 4 with (m+n) being 0 to 4 and (o+p) being 0 to 4. Two or more of $R^{13}$, $R^{14}$, $R^{15}$ and $R^{16}$ may be the same or different from each other.

The amine-based antioxidant represented by general formula (IV) is preferably asymmetric with $R^{13}$ or $R^{14}$ and $R^{15}$ or $R^{16}$ being alkyl groups having different numbers of carbon atoms from each other.

In general formula (IV), from the standpoint of easiness of production and so on, (m+n) and (o+p) are both preferably 1 and it is more preferred that the binding position of the alkyl group bonded to one of the naphthalene rings be the same as that of the alkyl group bonded to the other naphthalene ring. In addition, from the standpoint of ensuring high asymmetricity, the number of carbon atoms of $R^{13}$ or $R^{14}$ and the number of carbon atoms of $R^{15}$ or $R^{16}$ are both preferably 3 or greater and different from each other.

In the present invention, a compound represented by general formula (V) below is used as the dialkyl monophenylamine-based compound.

[Chemical Formula 4]

(V)

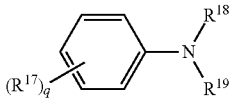

In general formula (V), $R^{17}$, $R^{18}$ and $R^{19}$ each independently represents a C1 to C20 alkyl group, preferably a C1 to C10 alkyl group, and "q" represents an integer of 0 to 4. Two or more of $R^{17}$ may be the same as or different from each other.

In the dialkyl monophenylamine-based compound represented by general formula (V), for example $R^{18}$ and $R^{19}$ preferably have different structures each other, and more preferably have different numbers of carbon atoms each other. In addition, from the standpoint of easiness of production and so on, "q" is preferably 0. From the standpoint of ensuring high asymmetricity, the number of carbon atoms of $R^{18}$ and the number of carbon atoms of $R^{19}$ are both preferably 3 or greater and different from each other.

As the dialkyl mononaphthylamine-based compound, a compound represented by general formula (VI) below is used.

[Chemical Formula 5]

(VI)

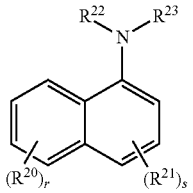

In general formula (IV), $R^{20}$, $R^{21}$, $R^{22}$ and $R^{23}$ each independently represents a C1 to C20 alkyl group, preferably a C1 to C10 alkyl group, and "r" and "s" each independently represents an integer of 0 to 4 with (r+s) being an integer of 0 to 4. Two or more of $R^{20}$ and $R^{21}$ may be the same as or different from each other.

In general formula (VI), $R^{22}$ and $R^{23}$ preferably have different structures, and more preferably have different number of carbon atoms in order to have high asymmetricity. In addition, in general formula (IV), "r" and "s" are preferably 0, and from the standpoint of ensuring high asymmetricity, the number of carbon atoms of $R^{22}$ and the number of carbon atoms of $R^{23}$ are both preferably 3 or greater and different from each other.

Examples of the alkyl group in general formulae (II) to (VI) include methyl group, ethyl group, n-propyl group, isopropyl group, various butyl groups, various pentyl groups, various hexyl groups, various heptyl groups, various octyl groups, various nonyl groups, various decyl groups, various undecyl groups, various dodecyl groups, various tridecyl groups, various tetradecyl groups, various pentadecyl groups, various hexadecyl groups, various heptadecyl groups and various octadecyl groups.

The asymmetric amine-based antioxidants described above may be used singly or in combination of two or more. The asymmetric amine-based antioxidant is preferably contained in an amount of 3% by mass to 10% by mass, more preferably 5% by mass to 9% by mass, in the lubricating oil composition for an air compressor. In the present invention, even when the asymmetric amine-based antioxidant is blended in a relatively large amount, the acid value of the lubricating oil composition can be reduced according to the blending amount. In addition, the oxidation preventing effect of the asymmetric amine-based antioxidant can remain effective over a long period of time.

The lubricating oil composition for an air compressor preferably has a kinematic viscosity at 100° C. of 6 to 12 $mm^2/s$. When the viscosity is equal to or higher than the above lower limit, the formation of an oil film between sliding surfaces in the air compressor is ensured, and therefore, a decrease in delivery flow rate due to a decrease in sealability at a compressing part or occurrence of machine trouble due to progress of frictional wear can be prevented. In addition, when the viscosity is equal to or lower than the above upper limit, the consumption of compressing power necessary to overcome the viscosity resistance or loss of required electric power can be reduced. More preferably, the kinematic viscosity at 100° C. is 6.5 to 10 $mm^2/s$.

In the present invention, even when the asymmetric amine-based antioxidant is blended in the relatively large amount as described above, the viscosity does not show a rapid rise and the viscosity of the lubricating oil composition for an air compressor can be therefore adjusted to an appropriate value.

The lubricating oil composition for an air compressor of the present invention may contain other additives, such as other antioxidants than the asymmetric amine-based antioxidant, metal deactivators, dispersants, antirusts and antifoaming agents.

Examples of the other antioxidants than the asymmetric amine-based antioxidant include phenol-based antioxidants, sulfur-based antioxidants and phosphorus-based antioxidants.

Examples of the phenol-based antioxidants include monophenol-based compounds such as 2,6-di-tert-butyl-4-methylphenol and 2,6-di-tert-butyl-4-ethylphenol, and diphenol-based compounds such as 4,4'-methylenebis(2,6-di-tert-butylphenol) and 2,2'-methylenebis (4-ethyl-6-tert-butylphenol).

Examples of the sulfur-based antioxidants include 2,6-di-tert-butyl-4-(4,6-bis(octylthio)-1,3,5-triazine-2-ylamino) phenol, thioterpene-based compounds such as a reaction product of phosphorus pentasulfide and pinene, and dialkyl thiodipropionates such as dilauryl thiodipropionate and distearyl thiodipropionate. Examples of the phosphorus-based antioxidants include diethyl 3,5-di-tert-butyl-4-hydroxybenzyl phosphonate.

The present invention also provides a method for lubricating an air compressor using the above lubricating oil composition.

In other words, the lubricating oil composition of the present invention is filled as a lubricating oil in an air compressor, and thereby the generation of sludge can be prevented and oxidation of the lubricating oil can be suppressed.

The examples of the air compressor to which the lubricating oil composition of the present invention can be applied include any types of air compressors such as centrifugal type and axial type turbo-compressors, reciprocating compressors using a piston or diaphragm, and screw type, movable vane type, scroll type and tooth type rotary-compressors. In particular, the application to a screw type rotary-compressor is preferred in the present invention.

EXAMPLES

Next, the following examples further describe the present invention in more detail, but it should be noted that the present invention is not limited at all by the examples.

The properties of the lubricating oil composition for an air compressor and the base oil were obtained according to the following procedures.

(1) Kinematic Viscosity at 100° C.

The kinematic viscosity at 100° C. of the lubricating oil composition for an air compressor was measured according to JIS K2283-1983 using a glass capillary viscometer.

(2) Acid Value

The acid value was measured at 40° C. according to the method specified in JIS K 2501.

The base oils and antioxidants used in Examples and Comparative Examples are as follows.

[Base Oil]

Ester 1: saturated fatty acid ester of pentaerythritol (ISO viscosity grade: VG46)

Ester 2: saturated fatty acid ester of pentaerythritol (compound equivalent to ester 1)

PAG1: polyoxypropylene glycol dimethyl ether (ISO viscosity grade: VG46)

PAG2: polyoxyalkylene glycol monomethyl ether (ISO viscosity grade: VG56; The main chain moiety contains 75 mol % of oxybutylene units and 25 mol % of oxyethylene units)

PAG3: polyoxypropylene glycol dimethyl ether (ISO viscosity grade: VG56)

PAG4: polyoxypropylene glycol monobutyl ether

PAG5: polyoxybutylene glycol butylmethyl ether

PAO: poly-α-olefin-based synthetic oil

[Antioxidant]

Antioxidant 1: monobutylphenyl-monooctylphenyl-amine

Antioxidant 2: diethyl 3,5-di-tert-butyl-4-hydroxybenzyl phosphonate

Antioxidant 3: 2,6-di-tert-butyl-4-(4,6-bis(octylthio)-1,3,5-triazine-2-ylamino)phenol Antioxidant 4: symmetric dialkyldiphenylamine Antioxidant 5: phenyl α-naphthylamine Antioxidant 6: symmetric dialkyldiphenylamine(dioctyldiphenylamine)

Antioxidant 7: p-tert-octylphenyl-1-naphthylamine

Antioxidant 8: symmetric dialkyldiphenylamine(dinonyldiphenylamine)

TABLE 1

| | | | Ex. 1 | Ex. 2 | Ex. 3 | Comp. Ex. 1 |
|---|---|---|---|---|---|---|
| Lubricating oil composition | Base oil | Ester 1 | 35.00 | 30.00 | 30.00 | — |
| | | Ester 2 | — | — | — | 47.00 |
| | | PAG1 | 44.30 | 61.04 | — | — |
| | | PAG2 | — | — | 46.04 | — |
| | | PAG3 | 11.64 | — | — | — |
| | | PAG4 | — | — | — | 47.00 |
| | | PAO | — | — | 15.00 | — |
| | Anti-oxidant | Anti-oxidant 1 | 8.00 | 8.00 | 8.00 | — |
| | | Anti-oxidant 2 | 0.20 | 0.50 | 0.50 | — |
| | | Anti-oxidant 3 | 0.30 | — | — | — |
| | | Anti-oxidant 4 | — | — | — | 5.00 |
| | Other additives | | 0.56 | 0.46 | 0.46 | 1.0 |
| Kinematic viscosity at 100° C. | | | 8.1 | 8.0 | 8.3 | 8.1 |

TABLE 1-continued

| | | | Ex. 1 | Ex. 2 | Ex. 3 | Comp. Ex. 1 |
|---|---|---|---|---|---|---|

*The numerical values in the lubricating oil compositions are % by mass, and symbol "—" means that the component was not blended.

*The value in the column "other additives" shows the total amount of a metal deactivator, an antirust and an antifoaming agent.

A modified Indiana oxidation test (IOT) was conducted on the lubricating oil compositions of Examples 1 to 3 and Comparative Example 1 shown in Table 1, and the acid values [mgKOH/g] at 480, 720, 960, 1200 and 1440 hours were measured. The modified Indiana oxidation test in Examples 1 to 3 and Comparative Example 1 was carried out under the following conditions; an oxygen gas was blown into the lubricating oil composition as tiny bubbles using a diffuser stone at a rate of 3 liter/hr at a test temperature of 140° C. with a spiral catalyst of Fe and Cu immersed therein so that the lubricating oil composition could undergo oxidation degradation. The test results are summarized in Table 2.

TABLE 2

| | Elapsed time [hr] | | | | | |
|---|---|---|---|---|---|---|
| | 0 | 480 | 720 | 960 | 1200 | 1440 |
| Ex. 1 | 0.28 | 3.55 | 4.14 | 3.74 | 3.87 | 3.53 |
| Ex. 2 | 0.27 | 3.83 | 3.92 | 3.92 | 3.95 | 3.54 |
| Ex. 3 | 0.28 | 3.26 | 3.63 | 3.45 | 3.66 | 3.33 |
| Comp. Ex. 1 | 0.14 | 1.46 | 1.91 | 6.25 | — | — |

*In Comparative Example 1, the test was ended at 960 hours because the acid value showed a rapid rise at 960 hours.

As is clear from Table 2, in Examples 1 to 3, in which asymmetric amine-based antioxidants were used in a large amount, the acid value was good even after the lapse of 1440 hours. This means that oxidation could be prevented stably over a long period of time. On the other hand, in Comparative Example 1, the acid value was stable after the lapse of a short period of time but the acid value showed a rapid rise, indicating that the lubricating oil underwent oxidation degradation, after the lapse of a long period of time. This means that oxidation could not be prevented stably over a long period of time.

The same modified Indiana oxidation test (IOT) as above was conducted on the lubricating oil compositions for an air compressor of Examples 4 to 8 shown in Table 3, and the acid value after the lapse of 168 hours was measured.

TABLE 3

| | | Ex. 4 | Ex. 5 | Ex. 6 | Ex. 7 | Ex. 8 |
|---|---|---|---|---|---|---|
| Lubricating oil composition | PAG5 | 98.8 | 97.6 | 95.2 | 93.8 | 90.4 |
| | Antioxidant 1 | 1.20 | 2.40 | 4.80 | 7.20 | 9.60 |
| Kinematic viscosity at 100° C. | | 9.1 | 9.1 | 9.2 | 9.2 | 9.3 |
| Modified IOT test result Acid value [mgKOH/g] | | 16.5 | 2.6 | 1.3 | 0.5 | 0.2 |

*The numerical values in the lubricating oil compositions are % by mass.

A modified Indiana oxidation test (IOT) was conducted on the lubricating oil compositions for an air compressor of Examples 9 to 13 shown in Table 4, and the acid value after the lapse of 168 hours was measured. The modified Indiana oxidation test in Examples 9 to 13 was conducted in the same manner as above except that the test temperature was changed to 190° C. The test results are summarized in Table 4.

TABLE 4

| | | Ex. 9 | Ex. 10 | Ex. 11 | Ex. 12 | Ex. 13 |
|---|---|---|---|---|---|---|
| Lubricating oil composition | Ester 1 | 96.47 | 95.97 | 94.97 | 94.22 | 93.47 |
| | Antioxidant 5 | 1.00 | 1.00 | 1.00 | 1.00 | 1.00 |
| | Antioxidant 6 | — | 0.50 | 1.50 | 2.25 | 3.00 |
| | Other additives | 2.53 | 2.53 | 2.53 | 2.53 | 2.53 |
| Kinematic viscosity at 100° C. | | 7.0 | 7.1 | 7.1 | 7.2 | 7.2 |
| Modified IOT test Acid value [mgKOH/g] | | 0.8 | 0.72 | 0.91 | 1.05 | 1.12 |

*The numerical values in the lubricating oil compositions are % by mass, and symbol "—" means that the component was not blended.
*The value in the column "other additives" shows the total amount of a metal deactivator, an antirust and an antifoaming agent.

Oxidation was successfully suppressed as the added amount of the asymmetric amine-based antioxidant was increased as shown in Examples 4 to 8 in Table 3. However, the acid value increased and thereby the antioxidant was hardly effective in preventing oxidation when the added amount of a symmetric amine-based antioxidant (antioxidant 6) was increased as shown in Examples 9 to 13 in Table 4.

A thermal stability test was conducted on the lubricating oil compositions of Examples 14 to 22 and Comparative Examples 2 to 12 shown in Table 5, and the acid value after the lapse of 48 hours was measured. This test was carried out by heating the lubricating oils to 170° C. The test results are summarized in Table 5.

TABLE 5-1

| | | Example | | | | | | | | |
|---|---|---|---|---|---|---|---|---|---|---|
| | | 14 | 15 | 16 | 17 | 18 | 19 | 20 | 21 | 22 |
| Lubricating oil composition | PAO | 99.8 | 99 | 98 | 96 | 92 | 99.9 | 99.5 | 99 | 98 |
| | Antioxidant 5 | 0.2 | 1.0 | 2.0 | 4.0 | 8.0 | — | — | — | — |
| | Antioxidant 7 | — | — | — | — | — | 0.1 | 0.5 | 1.0 | 2.0 |
| Kinematic viscosity at 100° C. | | 7.8 | 7.8 | 7.8 | 7.8 | 7.8 | 7.8 | 7.8 | 7.8 | 7.8 |
| Thermal stability test Acid value [mgKOH/g] | | 0.05 | 0.02 | 0.02 | 0.04 | 0.05 | 0.25 | 0.02 | 0.01 | 0.02 |

TABLE 5-2

| | | Comp. Example | | | | | | | | | | |
|---|---|---|---|---|---|---|---|---|---|---|---|---|
| | | 2 | 3 | 4 | 5 | 6 | 7 | 8 | 9 | 10 | 11 | 12 |
| Lubricating oil composition | PAO | | | | | | | | | | | |
| | Antioxidant 6 | 0 | 0.2 | 1.0 | 2 | 4.0 | — | — | — | — | — | — |
| | Antioxidant 8 | — | — | — | — | — | 0.1 | 0.2 | 0.4 | 1.0 | 2.0 | 4.0 |
| Kinematic viscosity at 100° C. | | 7.8 | 7.8 | 7.8 | 7.8 | 7.8 | 7.8 | 7.8 | 7.8 | 7.8 | 7.8 | 7.8 |
| Thermal stability test Acid value [mgKOH/g] | | 0.93 | 0.54 | 0.54 | 0.37 | 0.40 | 0.38 | 0.70 | 0.35 | 0.40 | 0.36 | 0.46 |

*The numerical values in the lubricating oil compositions are % by mass, and symbol "—" means that the component was not blended.

As is clear from Table 5-1, when the base oil was a poly-α-olefin-based synthetic oil, high thermal stability was achieved by using an asymmetric amine-based antioxidant even when the added amount of the asymmetric amine-based antioxidant was relatively small. On the other hand, as shown in Table 5-2, when a symmetric amine-based antioxidant was used, the thermal stability was inferior as compared to the case where an asymmetric amine-based antioxidant was used.

INDUSTRIAL APPLICABILITY

The lubricating oil composition for an air compressor of the present invention can successfully suppress oxidation of the lubricating oil and prevent the generation of sludge, and can therefore suitably used in air compressors.

The invention claimed is:

1. A lubricating oil composition, comprising a synthetic base oil and 2.40%-10% by mass of monobutylphenyl-monooctylphenyl-amine, wherein:

the synthetic base oil is one or more selected from the group consisting of a polyglycol-based synthetic oil, an ester of pentaerythritol with a saturated fatty acid, and a poly-α-olefin-based synthetic oil.

2. The lubricating oil composition according to claim 1, wherein the synthetic base oil is a mixed oil comprising said polyglycol-based synthetic oil and said ester of pentaerythritol with a saturated fatty acid.

3. The lubricating oil composition according to claim 1, wherein the synthetic base oil comprises the polyglycol-based synthetic oil, and 70 mol % or more of a main chain moiety of the polyglycol-based synthetic oil is C3 to C4 oxyalkylene units.

4. The lubricating oil composition according to claim 1, comprising 5% to 9% by mass of the monobutylphenyl-monooctylphenyl-amine.

5. The lubricating oil composition according to claim 1, wherein the composition has a kinematic viscosity at 100° C. of 6.5 to 10 $mm^2/s$.

6. An air compressor comprising the lubricating oil composition according to claim 1.

7. The lubricating oil composition according to claim 1, wherein the synthetic base oil comprises the polyglycol-based synthetic oil.

8. The lubricating oil composition according to claim 1, wherein the synthetic base oil comprises the ester of pentaerythritol with a saturated fatty acid.

9. The lubricating oil composition according to claim 1, wherein the synthetic base oil comprises the poly-α-olefin-based synthetic oil.

10. The lubricating oil composition according to claim 1, wherein:

said composition has a kinematic viscosity at 100° C. of 6 to 12 $mm^2/s$:

50 mol % or more of a main chain moiety of the polyglycol-based synthetic oil is C3 to C4 oxyalkylene units, and the polyglycol-based synthetic oil comprises a C1 to C4 alkyl group at a terminal end thereof; and the poly-α-olefin-based synthetic oil is a polymer of a C8 to C18 α-olefin.

* * * * *